US007266314B2

(12) United States Patent
Takami

(10) Patent No.: US 7,266,314 B2
(45) Date of Patent: Sep. 4, 2007

(54) IMAGE FORMING APPARATUS AND FIXING DEVICE USED THEREIN

(75) Inventor: Hiroshi Takami, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 133 days.

(21) Appl. No.: 11/183,879

(22) Filed: Jul. 19, 2005

(65) Prior Publication Data

US 2006/0024071 A1 Feb. 2, 2006

(30) Foreign Application Priority Data

Jul. 29, 2004 (JP) ..... 2004-221584

(51) Int. Cl.
*G03G 15/20* (2006.01)

(52) U.S. Cl. ..... 399/33

(58) Field of Classification Search ..... 399/33, 399/67, 69; 219/216; 374/1
See application file for complete search history.

(56) References Cited

U.S. PATENT DOCUMENTS

| | | | | |
|---|---|---|---|---|
| 4,104,692 | A * | 8/1978 | Sudo et al. | 219/216 X |
| 5,148,226 | A | 9/1992 | Setoriyama et al. | |
| 5,210,579 | A | 5/1993 | Setoriyama et al. | |
| 5,386,272 | A * | 1/1995 | Nakazato | 399/33 |
| 5,525,775 | A | 6/1996 | Setoriyama et al. | 219/216 |
| 6,026,257 | A | 2/2000 | Takami et al. | 399/666 |
| 6,421,139 | B1 | 7/2002 | Takami et al. | 359/1.2 |
| 6,640,064 | B2 * | 10/2003 | Kinoshita | 399/69 |
| 6,647,217 | B2 * | 11/2003 | Tomatsu | 399/33 |
| 6,744,993 | B2 | 6/2004 | Takami | 399/22 |
| 6,775,491 | B2 * | 8/2004 | Akutsu et al. | 399/69 |
| 6,870,140 | B2 * | 3/2005 | Cook et al. | 219/216 X |
| 7,146,116 | B2 * | 12/2006 | Nonaka et al. | 399/33 |
| 2005/0258158 | A1 | 11/2005 | Takami et al. | 219/216 |
| 2005/0280682 | A1 | 12/2005 | Kato et al. | 347/102 |
| 2006/0000819 | A1 | 1/2006 | Makihira et al. | 219/216 |

FOREIGN PATENT DOCUMENTS

| | | |
|---|---|---|
| JP | 4-44075 | 2/1992 |
| JP | 4-44076 | 2/1992 |
| JP | 4-44077 | 2/1992 |
| JP | 4-44078 | 2/1992 |
| JP | 4-44079 | 2/1992 |
| JP | 4-44080 | 2/1992 |
| JP | 4-44081 | 2/1992 |
| JP | 4-44082 | 2/1992 |
| JP | 4-44083 | 2/1992 |
| JP | 4-204980 | 7/1992 |
| JP | 4-204981 | 7/1992 |
| JP | 4-204982 | 7/1992 |
| JP | 4-204983 | 7/1992 |
| JP | 4-204984 | 7/1992 |
| JP | 8-248813 | 9/1996 |
| JP | 11-84943 | 3/1999 |
| JP | 11-344898 | 12/1999 |
| JP | 2003-50522 | 2/2003 |

* cited by examiner

*Primary Examiner*—Sandra L. Brase
(74) *Attorney, Agent, or Firm*—Fitzpatrick, Cella, Harper & Scinto

(57) ABSTRACT

A jumper cable is provided in a connector connected to an output signal of a temperature detection device and a detection signal line of fixing device specification means, and electric power supply to the temperature detection device is connected though the jumper cable. Therefore, when an electric connector connecting a main body of an image forming apparatus and a fixing device is disconnected, the overheating of the fixing device is avoided.

9 Claims, 6 Drawing Sheets

PRIOR ART

IMAGE FORMING APPARATUS AND FIXING DEVICE USED THEREIN

This application claims priority from Japanese Patent Application No. 2004-221584 filed Jul. 29, 2004, which is hereby incorporated by reference herein.

BACKGROUND OF THE INVENTION

1. Field of the Invention

The present invention relates to an image forming apparatus such as a copying machine and a printer in which an electrophotographic process is adopted. More particularly the invention relates to the image forming apparatus including image forming means for forming an unfixed toner image in a recording medium and heating and fixing means for heating and fixing the unfixed toner image to the recording medium.

2. Related Background Art

In the image forming apparatus, generally heating and fixing means (hereinafter referred to as fixing device) includes electric heat generation means (heat source) for having an electric heat generation member generating heat (corresponding to heat dissipation amount) by electrifying, a power supply which supplies current to the electric heat generation member, temperature detection means for detecting a temperature of the electric heat generation member, and control means for controlling supply current from the power supply to the electric heat generation member based on a signal from the temperature detection means.

(Unitization Configuration of Fixing Device)

In the electric heat generation member of the fixing device, an appropriate temperature and a heat distribution are required in order to secure desired fixing performance. Therefore, the electric heat generation members having different specifications are required depending on a rated supply voltage of the image forming apparatus. Specifically, the electric heat generation member having a small resistance value is required for a main body of the image forming apparatus whose rated supply voltage is 100V, and the electric heat generation member having a large resistance value is required for the main body of the image forming apparatus whose rated supply voltage is 200V.

Accordingly, usually the fixing device is unitized and the fixing device is adapted to be attachable to and detachable from the main body of the image forming apparatus. In the case of the unitized fixing device, as disclosed in Japanese Patent Application Laid-Open No. 2003-50522, a method of connecting the fixing device and the main body of the image forming apparatus with a connector is widely adopted.

(The Conventional Technologies for Anomalous Overheating Avoidance)

In the fixing device, an image fixing temperature is controlled at a predetermined temperature for image fixing by the above configuration. When any one of the electric heat generation member, the power supply, the temperature detection means, and the control means malfunctions in the fixing device, the fixing device does not work as the fixing device. Further, when electrifying runaway is generated, there is a fear that the fixing device overheats.

Therefore, in the fixing device, as disclosed in Japanese Patent Application Laid-Open No. H08-248813, the temperature detection means such as a thermistor is arranged in the electric heat generation means. When the fixing device is in an overheating state, electrifying the electric heat generation member is cut off by current cut-off means such as a relay inserted into an electrifying circuit.

FIG. 7 shows a configuration of the conventional overheating avoidance device in the image forming apparatus. The reference numeral 1001 denotes a main body of the image forming apparatus, and the reference numeral 1002 denotes a fixing device attachable to and detachable from the image forming apparatus 1001. The image forming apparatus 1001 and the fixing device 1002 are electrically connected to each other through connectors 1006 and 1007. An AC power supply 1005 is connected to an electric heat generation member 1003 through the connector 1006. The electric heat generation member 1003 is electric heat dissipating means on the fixing device 1002 side. On the other hand, a thermistor 1004 which is of temperature detecting means is connected through the connector 1007. The thermistor 1004 is arranged near the electric heat generation member 1003 which is of the electric heat dissipating means. The output voltage of the thermistor 1004 is divided by a resistor 1014 and input to an operational amplifier 1011. The divided voltage level of resistors 1012 and 1013 is also input to the operational amplifier 1011, and the divided voltage level is compared to the output level of the thermistor 1004. When the thermistor 1004 is higher than a predetermined temperature, a relay 1009 is cut off to stop the power supply to the electric heat generation member 1003.

(Conventional Technologies for Fixing-Device Specifications Identification)

In the image forming apparatus to which the unitized fixing device is attached, mismatching is generated when the heat generation member is attached to the image forming apparatus while the rated supply voltage of the image forming apparatus and the heat generation member specification of the fixing device are wrongly combined. In order to avoid the mismatching, Japanese Patent Application Laid-Open No. H11-84943 discloses a mode in which rated voltage identifying means is provided in the fixing device. In the system, when the mismatching is generated between the fixing device and the image forming apparatus, electrifying the electric heat generation member is stopped.

Referring to FIG. 7, the conventional rated voltage identifying mode will be described. The method of connecting first and second terminals of the connector 1007 on the fixing device side is set according to the rated supply voltage. The second terminal is connected to a ground GND on the image forming apparatus 1001 side. On the other hand, the first terminal is pulled-up by a resistor 1016 and connected to an input port of a CPU 1017. When the rated supply voltage of the fixing device 1002 is 100V, the CPU 1017 can detect the rated supply voltage of the fixing device 1002 by connecting the first terminal and the second terminal to each other with a jumper cable 1008. When the rated supply voltage is 200V, the CPU 1017 can detect the rated supply voltage of the fixing device 1002 by not connecting the first terminal and the second terminal to each other with the jumper cable 1008. At this point, when the CPU determined that the fixing device 1002 differs from the image forming apparatus 1001 in the rated supply voltage, the heat generation member is not electrified by turning off a triac 1010.

However, in the image forming apparatus in which the unitized fixing device described above is electrically connected to the main body of the image forming apparatus with the connectors 1006 and 1007, the overheating avoiding means and the fixing device specifications identifying means are not normally operated when the control-system connector 1007 is not connected while the power-supply-system connector 1006 is in the connected state (fitted state). When the power-supply-system connector 1006 is not connected, the overheating is not generated because the electric power is not supplied to the fixing device side.

The action when the control-system connector 1007 is in the disconnected state while the power supply-system-connector 1006 is in the connected state (fitted state) in the image forming apparatus having the configuration of FIG. 7 will be described below. When a fourth terminal for thermistor detection signal which is of a temperature detection signal is not connected by the disconnection of the connector 1007, the CPU becomes a Vcc level by the pull-up of the resistor 1014. Because the thermistor 1004 has the signal level of the low temperature state, software control of the CPU 1017 causes the triac to be electrified, resulting the overheating state of the electric heat generation member 1003. Further, the relay 1009 does not become the cut-off state. Accordingly, the overheating cannot be avoided. When the first and second terminals of the rated voltage identifying means is not connected, because the first and second terminals become the Vcc level by resistors 1015 and 1016, there is a fear that the CPU 1017 cannot identify the rated voltage to generate the overheating.

Although Japanese Patent Application Laid-Open No. H11-344898 teaches a conventional type in those kinds of circuits, a safety circuit having a simpler and safer circuitry than those is desired.

SUMMARY OF THE INVENTION

In view of the foregoing, an object of the invention is to avoid the generation of the overheating of the fixing device even if the control-system connecting the main body of the image forming apparatus and the fixing device is in the disconnected state.

In order to achieve the object, a main body of an image forming apparatus according to the invention to which a heat fixing device is attached, the heat fixing device having a heat generating part which has an electric heat generation member for generating heat by electrifying and a temperature detection device for detecting a temperature of the heat generating part, the heat fixing device heating and fixing an unfixed toner image onto a recording medium, the main body of the image forming apparatus having an image forming part which forms the unfixed toner image in the recording medium, the main body of the image forming apparatus includes a control part which controls electric power supplied to the electric heat generation member; an electric power supply cut-off circuit which cuts off electric power supply to the electric heat generation member; and a determination circuit which causes the electric power supply cut-off circuit to be in a cut-off state by determining whether output of the temperature detection device indicates a predetermined anomaly, wherein the heat fixing device and the main body of the image forming apparatus are electrically connected to each other with a first connector, the temperature detection device and the determination circuit are connected through the first connector, power supply voltage is supplied to the temperature detection device via a jumper cable connected to the first connector from the main body of the image forming apparatus while passing through a path detouring to the heat fixing device side, and the determination circuit causes the electric power supply cut-off circuit to be cut off, when the power supply voltage is not supplied to the temperature detection device because the first connector is in a disconnected state.

Namely, in the image forming apparatus (main body), even if the control-system first connector including the detection signal of the temperature detection device is disconnected, electrifying the electric heat generation member of an electric heat generation device which is of a heat source is cut off by operation of a safety device, which allows the overheating of the heat fixing device to be prevented.

Preferably, the heat fixing device has a specification signal output part which outputs a signal indicating specifications of the heat fixing device, the signal from the specification signal output part is transmitted to the control part via a second connector, the control part controls the electric power supplied to the electric heat generation member based on the specifications signal, the power supply voltage is supplied to the temperature detection device via the jumper cable connected to the first connector and via the jumper cable connected the second connector while passing through path detouring twice to the heat fixing device side, and the determination circuit causes the electric power supply cut-off circuit to be cut off, when the power supply voltage is not supplied to the temperature detection device because at least one of the first connector and the second connector is in the disconnected state.

Preferably, the heat fixing device has the specification signal output part which outputs the signal indicating the specifications of the heat fixing device, the signal from the specification signal output part is transmitted to the control part via the first connector, and the control part controls the electric power supplied to the electric heat generation member based on the specifications signal.

Preferably, the temperature detection device is a thermistor.

Preferably, the specification signal output part outputs a signal indicating a rated supply voltage to be supplied to the fixing device.

Preferably, plurality terminals are arranged in line in the connector, and a connection terminal for an output signal of the temperature detection signal and a connection terminal for a signal from the specification signal output part are arranged in insides of two terminals to which the jumper cables are connected.

Preferably, the plural terminals are arranged in line in the first connector, and the connection terminal for the output signal of the temperature detection signal is arranged in the insides of the two terminals to which the jumper cables are connected.

Preferably, the plural terminals are arranged in line in the second connector, and the connection terminal for the signal from the specification signal output part is arranged in the insides of the two terminals to which the jumper cables are connected.

Preferably, the invention is an image forming apparatus including a main body of the image forming apparatus; a heat generating part which has an electric heat generation member, the heat generating member generating heat by electrifying; a temperature detection device which detects a temperature of the heat generating part; and a heat fixing device which heats and fixes an unfixed toner image onto a recording medium.

Even if the second connector for transmitting the detection signal of the temperature detection device or the third signal for transmitting the signal from the specification signal output part is disconnected, electrifying the electric heat generation member of an electric heat generation device which is of a heat source is cut off by the operation of the safety device, which allows the overheating of the heat fixing device to be prevented.

DETAILED DESCRIPTION OF THE PREFERRED EMBODIMENTS

First Embodiment (1) Image Forming Apparatus

Figure 1:
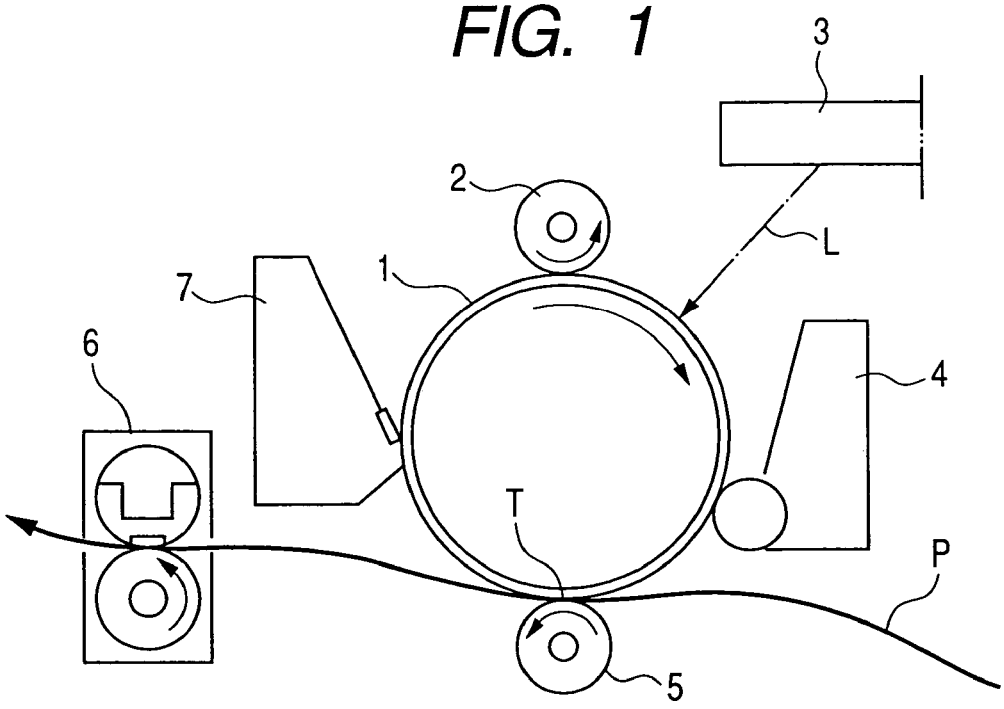
FIG. 1 is a schematic view showing a configuration of an image forming apparatus according to a first embodiment of the invention.

FIG. 1 is a schematic sectional view for explaining a configuration of a main part of an image forming apparatus. The image forming apparatus of a first embodiment is a laser beam printer in which a transfer type electrophotographic process is adopted.

The reference numeral 1 denotes a photosensitive drum which is of an image bearing body. In the photosensitive drum 1, a photosensitive material such as an organic photoconductive (OPC) material, amorphous Se, and amorphous Si is formed on a cylindrical substrate made of aluminum, nickel, and the like. The photosensitive drum 1 is rotated and driven in a clockwise direction shown by an arrow of FIG. 1, and a surface of the photosensitive drum 1 is evenly charged by a charging roller 2 which is of a charging device. Then, scanning exposure of a laser beam L is performed to the evenly charged surface of the photosensitive drum 1 to form an electrostatic latent image on the surface of the photosensitive drum 1 by a laser scanner part 3 which is of an image exposure device. The laser beam L is on-and-off-controlled according to image information. The electrostatic latent image is developed and visualized by a developing device 4. Example of the developing method includes a jumping development method, a two-component developing method, and a FEED (Floating Electrode Effect Development) method. A combination of image exposure and reversal development is often used. The visualized toner image is electrostatically transferred onto recording paper (transfer material) P from the surface of the photosensitive drum 1 by a transfer roller 5. The recording paper P which is of a recording medium is conveyed at predetermined timing from a paper-feed mechanism part (not shown) to a transfer nip portion T. The transfer nip portion is an abutting portion between the photosensitive drum 1 and the transfer roller 5 which is of a transfer device. The recording paper P is conveyed while sandwiched between the photosensitive drum 1 and the transfer roller 5 with constant pressing force. The recording paper P to which the toner image has been transferred in the transfer nip portion T is separated from the surface of the photosensitive drum 1. Then, the recording paper P is conveyed to a fixing device 6 which is of heating and fixing means, and the recording paper P is heated and fixed as a permanent image by the fixing device 6. On the other hand, residual toner remaining on the photosensitive drum 1 is removed from the surface of the photosensitive drum 1 by a cleaning device 7. The photosensitive drum 1 is repeatedly provided for the image formation.

In the image forming apparatus of the first embodiment, a conveyance reference is a center reference in which the reference is set in the center of the recording paper P in all the conveying paths.

(2) Fixing Device 6

The fixing device 6 which is of the heating and fixing means is adapted to be a fixing part, which is attachable to and detachable from the main body of the image forming apparatus. In the fixing device 6 attached to the main body of the image forming apparatus, the electric system on the fixing device side and the electric system on the main body side of the image forming apparatus are electrically connected to each other with an electric connector. The electric connection will specifically be described later.

Figure 2:
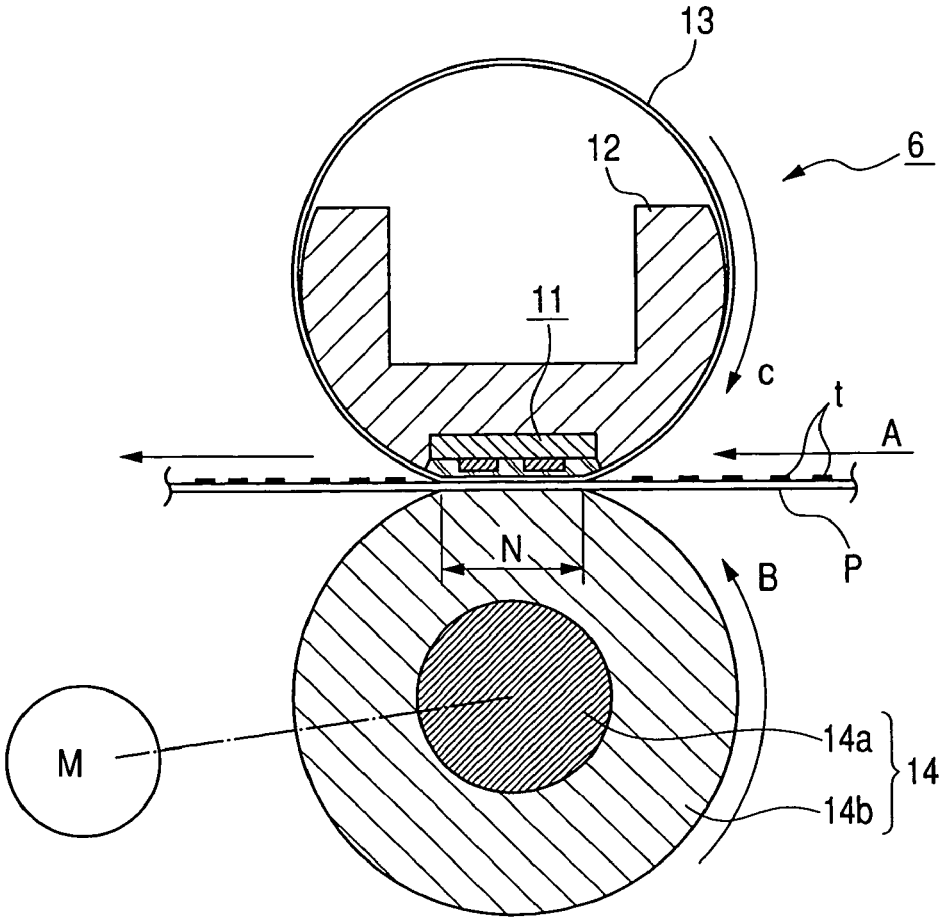
FIG. 2 is a schematic view showing a configuration of a fixing device in the first embodiment.

FIG. 2 is a schematic sectional view showing a main part of the fixing device 6. The fixing device 6 of the first embodiment is a fixing device which is a pressure roller driving type/a film heating type without tension, and disclosed in Japanese Patent Application Laid-Open Nos. H04-44075 to H04-44083, and H04-204980 to H04-204984.

The reference numeral 11 denotes a heating member which is of the electric heat generation means, and the heating member 11 is a long member whose direction perpendicular to a paper plane is set at a longitudinal direction. The heating member of the first embodiment is the so-called ceramic heater. The reference numeral 12 denotes a rigid stay having heat-resistant properties and heat insulating properties, which is of a ceramic heater support. The ceramic heater 11 is fitted into a groove portion formed along the longitudinal direction in a lower surface of the stay 12, and the ceramic heater 11 is fixed and supported by a heat-resistant bonding material. The reference numeral 13 denotes a cylindrical flexible member, and the stay 12 to which the ceramic heater 11 is attached is loosely fitted into the cylindrical flexible member 13.

For example, the cylindrical flexible member (hereinafter referred to as film) 13 is formed by a cylindrical single-layer film made of PTFE, PFA, FEP, and the like. The cylindrical single-layer film has a thickness ranging from 40 to 100 μm. PTFE, PFA, and FEP have the heat-resistant properties, mold releasing properties, strength, and durability. The cylindrical flexible member 13 is also formed by a composite-layer film in which an outer surface of the cylindrical film made of polyimide, polyamide, PEEK, PES, PPS, and the like PTFE, PFA, FEP, and the like is coated with PTFE, PFA, FEP, and the like. It is also possible that the cylindrical flexible member 13 is formed by a metal film.

The reference numeral 14 denotes a pressure roller which is of the pressing member. The pressure roller 14 is an elastic roller in which a heat-resistant elastic layer 14*b* made of silicone rubber and the like is provided in a roller shape on an outer periphery of a core bar 14*a*. A fixing nip portion N having a predetermined width is formed by the pressure roller 14 and the ceramic heater 11 located on the stay 12 side. The film 13 is sandwiched between the pressure roller 14 and the ceramic heater 11 while pressed against the elasticity of the pressure roller 14.

The pressure roller 14 is rotated and driven at predetermined circumferential speed in a counter clockwise direction of an arrow B by a fixing drive motor M. When the pressure roller 14 is rotated, torque acts directly on the film 13 by frictional force between the outer surfaces of the pressure roller 14 and the ceramic heater 11 at the fixing nip portion N (torque acts indirectly on the film 13 through the recording paper P when the recording paper P is introduced to the fixing nip portion N in the direction of an arrow A), and the film 13 is rotated and driven in a clockwise direction of an arrow C while being pressed against and sliding on the lower surface of the heater 11. The stay 12 also functions as a film inner surface guide member to facilitate the rotation of the film 13. In order to reduce sliding resistance between the inner surface of the film 13 and the lower surface of the ceramic heater 11, it is also possible that a small amount of lubricant such as heat-resistant grease is applied between the inner surface of the film 13 and the lower surface of the ceramic heater 11.

The rotation of the film 13 by the rotation of the pressure roller 14 is stabilized, the temperature of the ceramic heater 11 is raised by electrifying the ceramic heater 11, and the ceramic heater 12 is adjusted at a predetermined fixing temperature. In the state of things, the recording paper P in which the image should be fixed is introduced to the fixing nip portion N between the ceramic heater 11 and the pressure roller 14, in which the film 13 is sandwiched. Then, the recording paper P is sandwiched and conveyed in the fixing nip portion along with the film 13, which allows the heat of the ceramic heater 11 to be given to the recording paper P and an unfixed toner image t to fix the unfixed toner t onto the recording paper P. The recording paper P which has passed through the fixing nip portion N is conveyed while separated from the surface of the film 13.

Figures 3A, 3B, 3C, 3D:
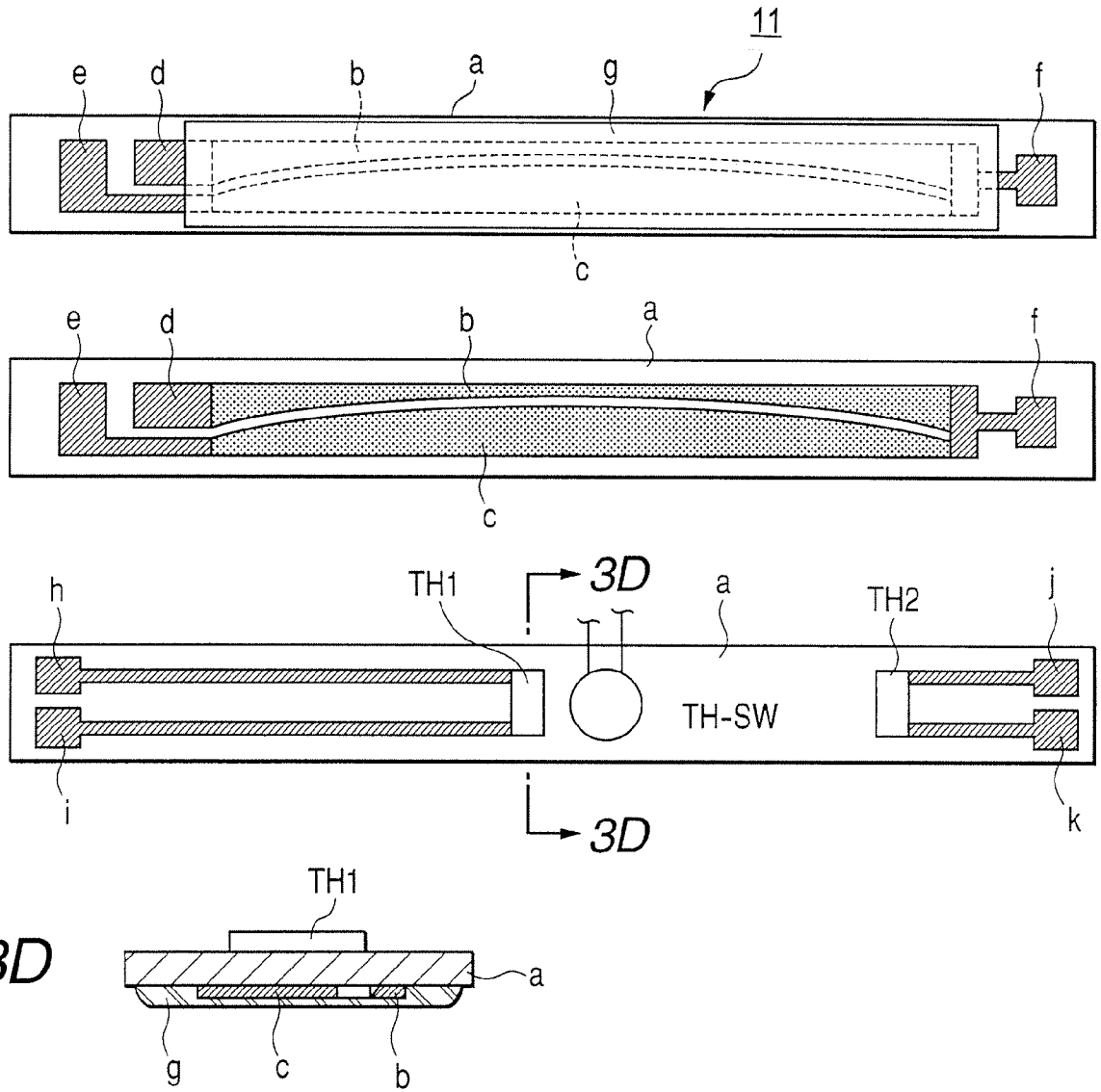
FIGS. 3A, 3B and 3C are a schematic view showing a ceramic heater in the first embodiment.
FIG. 3D is a sectional view of FIG. 3C.

FIG. 3 is a schematic view showing the configuration of the ceramic heater 11 in the first embodiment. FIG. 3A is a schematic plan view showing a surface side of the ceramic heater 11, FIG. 3B is a schematic plan view showing the surface side of the ceramic heater 11 when a surface protection layer is removed, FIG. 3C is a schematic plan view showing a backside of the ceramic heater 12, and FIG. 3D is an enlarged sectional view taken on line 3D-3D of FIG. 3C. The reference sign a denotes a ceramic heater base material (substrate). The substrate a is made of a ceramic material, such as alumina and aluminum nitride, having the heat-resistant properties, good thermal conductive properties, and electric insulating properties. The substrate a is a long and thin member whose direction intersecting (orthogonal to) a paper the recording paper conveying direction A is set at the longitudinal direction. Alumina ($Al_2O_3$) is used as the substrate a.

The signs b and c denote first and second electric heat generation member patterns (hereinafter referred to as main heater and sub-heater) which are formed on one side (surface side) of the heater substrate a. The first and second electric heat generation member patterns generate the heat by electrifying the first and second electric heat generation member patterns. The main heater b and the sub-heater c are formed in the longitudinal direction of the substrate by thick film printing with paste made of resistance heat generation material. The main heater b and the sub-heater c are arranged in the recording paper conveying direction (substrate crosswise direction).

The sign d denotes an electric power supply electrode (hereinafter referred to as main contact). The main contact d is formed while electrically connected to one end portion in the longitudinal direction of the main heater b. The sign e denotes an electric power supply electrode (hereinafter referred to as sub-contact). The sub-contact e is formed while electrically connected to one end portion in the longitudinal direction of the sub-heater c. The sign f denotes an electric power supply electrode (hereinafter referred to as common contact). The common contact e is formed while electrically connected to the other end portion in the longitudinal direction of each of the main heater b and the sub-heater c.

The main contact d, the sub-contact e, and the common contact f are formed as a conductive pattern on the surface on both end-portion sides of the ceramic heater substrate by the thick film printing.

The sign g denotes a surface protection layer which is formed on the surface of the substrate a while the main heater b, the sub-heater c, a part of the main contact d, a part of the sub-contact e, and a part of the common contact f are covered with the surface protection layer. The surface protection layer is formed as a glass coating pattern by the thick film printing. The inner surface of the fixing film 13 slides on the surface of the surface protection layer g while being in close contact with the surface of the surface protection layer g.

Figure 4:
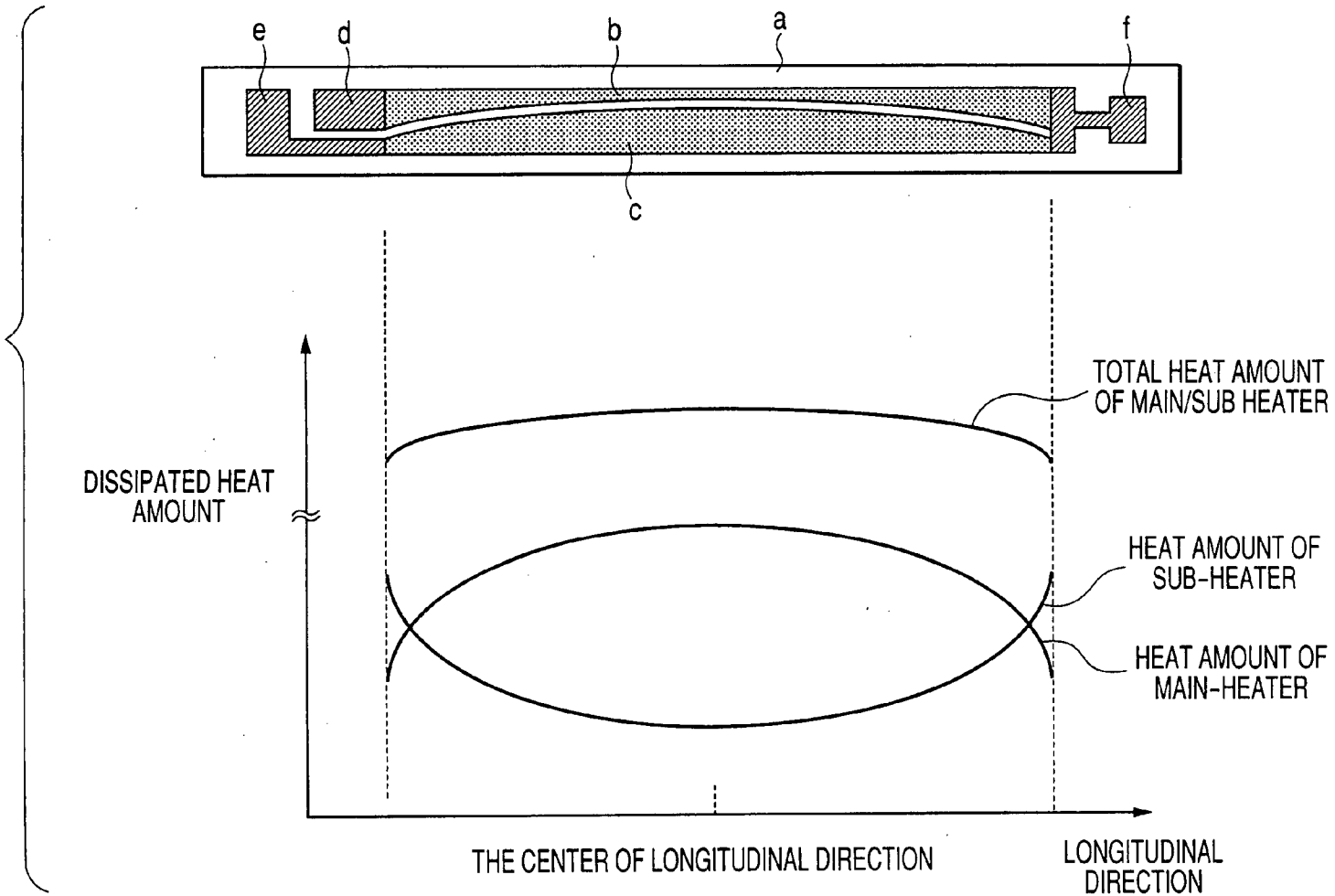
FIG. 4 is a view showing dissipated heat distributions of a main heater and a sub-heater of the ceramic heater.

The main heater b largely differs from the sub-heater c in a heat generation distribution. FIG. 4 shows the heat generation distributions along the longitudinal directions of the main heater b and the sub-heater c. The main heater b is formed such that a dissipated heat amount is increased at a central portion of the longitudinal direction. On the other hand, the sub-heater c is formed such that the dissipated heat amount is decreased at end portions. The total heat amount of the dissipated heat amounts of the main heater b and the sub-heater c is substantially constant along the longitudinal direction.

The sign TH1 and TH2 denote a main thermistor and a sub-thermistor respectively which are of first and second temperature detection means for measuring the temperature of the ceramic heater 11. The main thermistor TH1 is arranged at the central portion in the longitudinal direction in the backside of the ceramic heater 11, and the sub-thermistor TH2 is arranged at the end portion in the backside of the ceramic heater 11. The main thermistor TH1 and the sub-thermistor TH2 are pressed against the ceramic substrate a with predetermined pressure respectively. The signs h and i denote lead electric paths which are electrically connected to the main thermistor TH1 (hereinafter referred to as main thermistor contact). The signs j and k denote lead electric paths which are electrically connected to the sub-thermistor TH2 (hereinafter referred to as sub-thermistor contact). The thermistor contacts h, i, j, and k are formed as the conductive pattern in the backside of the ceramic heater substrate by the thick film printing.

The sign TH-SW denotes a thermo-switch which is of the safety device. The thermo-switch TH-SW is the current cut-off means in the overheating of the ceramic heater 11. The thermo-switch TH-SW is arranged at the central portion in the backside of the ceramic heater 11 while pressed against the ceramic substrate a with predetermined pressure. The thermo-switch is operated at a temperature of 250° C.

(3) Electric Connection Between Fixing Device and Image Forming Apparatus

Figure 5:
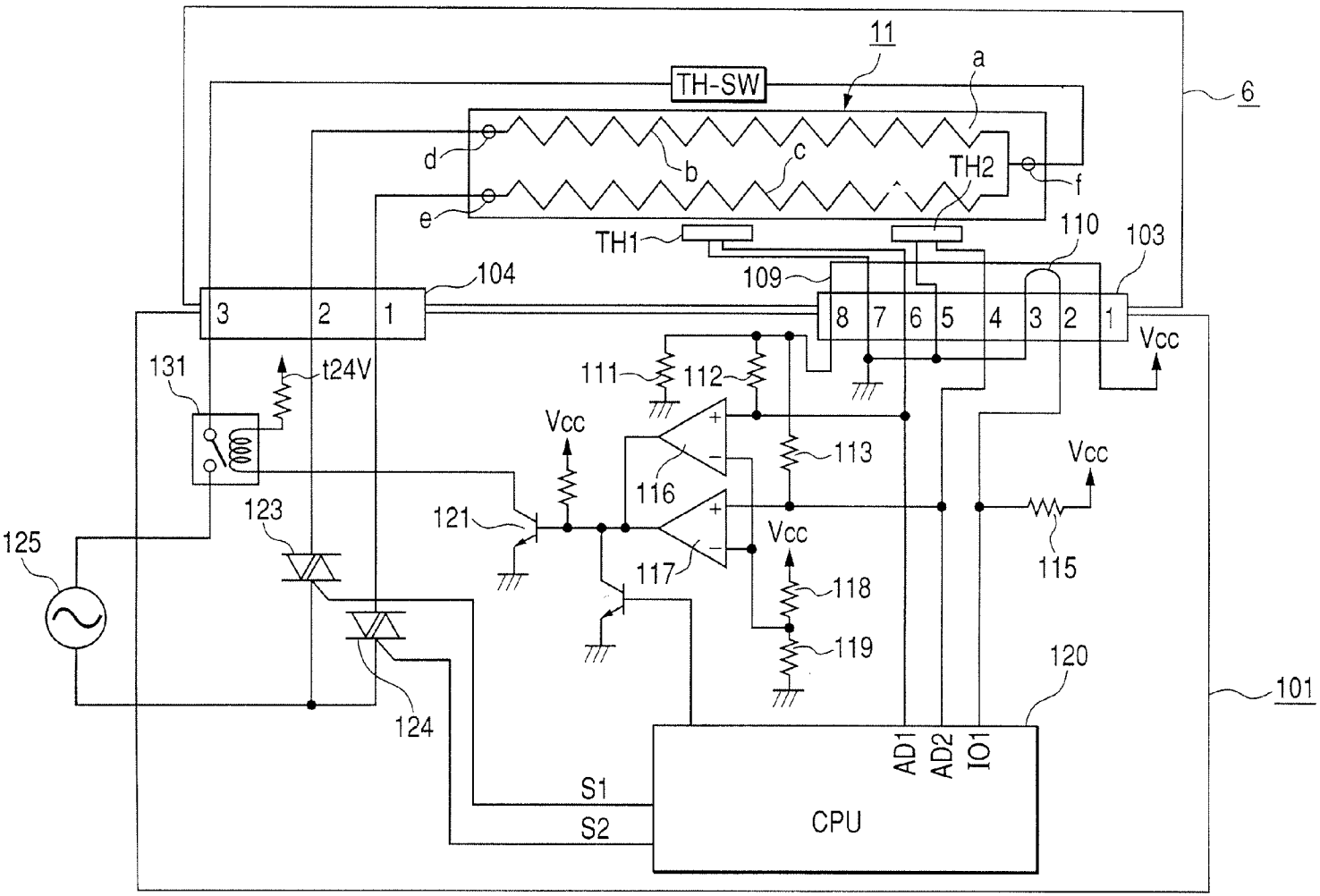
FIG. 5 is a circuit diagram showing a fixing control part in the first embodiment.

The fixing device 6 is formed in the unitized fixing part which is attachable to and detachable from main body of the image forming apparatus. In the fixing device 6 attached to the main body of the image forming apparatus, the electric system on the fixing device side and the electric system on the main body side of the image forming apparatus are electrically connected to each other with the electric connector. FIG. 5 shows the electric system on the fixing device 6 side and the electric system on the main body side of the image forming apparatus 101. The electric systems on the fixing device 6 side and the main body side 101 of the image forming apparatus will be described below.

1) Connector

The reference numerals 103 and 104 denote first and second electric connectors. The connectors 103 and 104 are formed such that a connector portion on the main body side of the image forming apparatus 101 and a connector portion on the fixing device 6 side are fitted to the connectors 103 and 104. In the fixing device 6 attached to the main body of the image forming apparatus 101, the electric system on the fixing device 6 side and the electric system on the main body side of the image forming apparatus 101 are electrically connected to each other with the electric connectors 103 and 104.

The first connector 103 (connector A) is the control-system connector. The first connector 103 is connected to a line of a fixing rated voltage detection signal indicating the later-mentioned fixing rated voltage while electrically connecting the main thermistor TH1 and the sub-thermistor TH2 of the ceramic heater 11 located on the fixing device 6 side and a control line on the main body side of the image forming apparatus 101. The first connector 103 has eight terminals.

The second connector 104 is the electric-power-supply-system connector. The second connector 104 electrically connects the main heater b and the sub-heater c of the ceramic heater 11 located on the fixing device 6 side and an electric-power-supply-line on the main body side of the image forming apparatus 101. The second connector 104 has three terminals.

In the connectors 103 and 104, the terminals are arranged in line. For a number of the terminal, the number is allocated from the terminal located at the end portion in the order of 1, 2, 3, . . . .

2) Electric Power Control Circuit

Then, an electric power control circuit which supplies the electric power to the ceramic heater 11 will be described. The electric power control is independently performed in the main heater b and the sub-heater c. The reference numeral 120 denotes the CPU which is of the control means. The reference numerals 123 and 124 denote first and second triacs. The first and second triacs 123 and 124 are the current control means for controlling the dissipated heat amount of the ceramic heater 11 which is of the electric heat generation means by controlling the current supplied to the main heater b and the sub-heater c which are of the electric heat generation member. The reference numeral 125 denotes an AC power supply. The reference numeral 131 denotes a relay. The first triac 123 and the main heater b are connected in series through the terminal 2 of the second connector 104, and the second triac 124 and the sub-heater c are connected in series through the terminal 1 of the second connector 104. The first and second triacs 123 and 124 are connected to the AC power supply 125 in parallel. The first and second triacs 123 and 124 are ON-and-OFF-controlled by ON and OFF of first and second heater drive signals S1 and S2 from the CPU 120 respectively. The relay 131 is inserted between the main heater b and sub-heater c and the AC power supply 125. Driving the relay 131 can cut off electrifying the main heater b and the sub-heater c. A control signal of the relay 131 is connected to the later-mentioned safety circuit.

3) Temperature Detection Circuit

The main thermistor TH1 and the sub-thermistor TH2, which are provided in the fixing device 6, are connected to the main body of the image forming apparatus 101 through the first connector 103. One line of the main thermistor TH1 is connected to a ground, and the other line is connected to an analog digital input port (AD port) AD1 of the CPU 120, a resistor 112, and a comparator 116. The resistor 112 is connected to the power supply Vcc through the connector 103. The voltage level divided by the resistor 112 and the resistance value of the main thermistor TH1 is input to the AD port AD1. Namely, the voltage level according to the temperature of the ceramic heater 11 detected by the sub-thermistor TH2 is input to the AD port AD1. For the sub-thermistor TH2, the voltage level according to the temperature of the ceramic heater 11 detected by the sub-thermistor TH2 is input to the AD port AD2 by the same action for the main thermistor TH1. Thus, the ceramic heater 11 can be controlled at the desired temperature by driving the electric power control circuit according to the temperatures detected by the main thermistor TH1 and the sub-thermistor TH2. The comparator 116 and 117 are the temperature comparing means for comparing a reference values to the output values of the main thermistor TH1 and the sub-thermistor TH2 which are of the temperature detection means.

4) Safety Circuit

In the image forming apparatus of the first embodiment, the safety device is provided to avoid the ceramic heater 11 from overheating during the electrifying runaway. In addition to the thermo-switch TH-SW, a safety circuit in which the overheating of the ceramic heater 11 is detected by the thermistor to cut off the electrifying is also provided as the safety device.

As described above, the thermo-switch TH-SW is the current cut-off means during the overheating of the ceramic heater 11, and the thermo-switch TH-SW is inserted in series into the electric power supply line to the main heater b and the sub-heater c. When the ceramic heater 11 is excessively raised to the action temperature of 250° C. of the thermo-switch TH-SW, the thermo-switch TH-SW performs the current cut-off action to cut off the electric power supply to the main heater b and the sub-heater c.

The action of the safety circuit which is of alternative safety device will be described below. The detection signal of the main thermistor TH1 is input to a positive-electrode input terminal of the comparator 116 while input to the CPU 120 through the first connector 103, so that the detection signal of the main thermistor TH1 is compared to the voltage level of the negative electrode. The voltage level in which the power supply voltage Vcc is divided by the resistors 119 and 118 is input to the negative-electrode terminal. The voltage level of the negative-electrode terminal is set at a value corresponding to the case in which the detection temperature of the main thermistor TH1 is 230° C. Accordingly, the comparator 116 becomes "High state" when the detection temperature of the main thermistor TH1 is lower than 230° C., and the comparator 116 "becomes "Low state" when the detection temperature of the main thermistor TH1 is not lower than 230° C. The output of the comparator 116 is connected to a base terminal of a transistor 121 which drives the relay 131. Therefore, when the detection temperature of the main thermistor TH1 is not lower than 230° C., the transistor 121 becomes the off state and the relay becomes the cut-off state, which cuts off electrifying the ceramic heater 11. As with the main thermistor TH1, when the detection temperature of the sub-thermistor TH2 is not lower than 230° C., electrifying the ceramic heater 11 is also cut off by the relay in the sub-thermistor TH2. Namely, when the detection temperature of the main thermistor TH1 or the sub-thermistor TH2 is not lower than 230° C., electrifying the ceramic heater 11 is cut off by the relay 131, which allows the ceramic heater 11 to be prevented from overheating. The relay 131 is the electric power supply and cut-off means for cutting off the electric power supply to the main heater b and the sub-heater c which are of the electric heat generation member based on the comparison results of the comparators 116 and 117 which are of the temperature comparison detection means.

The action of the safety circuit when the control-system first connector 103 (connector A) is disconnected while the electric-power-supply-system second connector 104 is in the connected state (fitted state) will be described. In the case when the electric-power-supply-system second connector 104 is not connected, the overheating is not generated because the electric power supply is not performed to the fixing device side.

When the disconnection of the control-system first connector 103 is generated, the main thermistor TH1 and sub-thermistor TH2 are not connected to the safety circuit. The first terminal and the eighth terminal connected to each other with the jumper cable 109 (jumper cable A1) becomes the disconnected state in the fixing device 6, and thereby electrifying the resistors 112 and 113 from the power supply voltage Vcc is cut off. Therefore, the positive electrodes of the comparators 116 and 117 are connected to the ground by the resistor 111. On the other hand, because the voltage in which the power supply voltage Vcc is divided by the resistors 119 and 118 is applied to the negative electrodes, the outputs of the comparator 116 and 117 become the Low state. Namely, the relay 131 becomes the cut-off state and electrifying the ceramic heater 11 is stopped, so that the overheating of the ceramic heater 11 is not generated.

In the first connector 103, the terminals 6 and 7 of the main thermistor TH1 and the terminals 4 and 5 of the sub-thermistor TH2 are arranged inside with respect to the terminals 1 and 8 connected to the jumper cable 109 (the terminals 4, 5, 6, and 7 are sandwiched between the terminals 1 and 8). Therefore, even if only the terminals 4, 5, 6, 7, and 8 are disconnected when the first connector 103 is fitted in the incomplete state (single-side fitting), electrifying the resistors 112 and 113 from the power supply voltage Vcc is cut off, which allows electrifying the ceramic heater 11 to be avoided.

(9) Fixing Rated Voltage Detection Means

In the image forming apparatus of the first embodiment, means for detecting the rated supply voltage of the fixing device 6 is provided as heating and fixing specification detection means (fixing device detection means), so that the use and attachment of the rated supply voltage which is not suitable to the main body of the image forming apparatus 101 are prevented in the fixing device 6. In the main body of the image forming apparatus 101, because there are two rated supply voltages of 100V and 200V, the fixing device 6 is also compatible with 100 and 200V. The second and third terminals of the first connector 103 are the connection terminal for the jumper cable 110 which is set according to the rated supply voltage of the fixing device 6. In the case of the rated supply voltage of 100V, the second and third terminals of the first connector 103 are short-circuited by the jumper cable 110. On the other hand, in the case of the rated supply voltage of 200V, the jumper cable 110 is not connected. When the fixing device 6 is attached to the main body of the image forming apparatus 101, the fourth terminal of the first connector 103 is connected to the ground in the main body of the image forming apparatus 101. The second terminal is connected to the input port L01 of the CPU 120 and the resistor 115. One end of the resistor 115 is connected to the power supply Vcc. When the rated supply voltage of the fixing device 6 is 100V, the third terminal becomes the GND level by the jumper cable 101. Namely, the input port I01 is fixed to the Vcc level. On the other hand, when the rated supply voltage of the fixing device 6 is 200V, the second terminal is fixed to the power supply voltage Vcc level by the resistor 115. The software for controlling the CPU 120 identifies the rated supply voltage of the fixing device 6 from the state of the input port I01. When the software determined that the fixing device 6 is suitable to the main body of the image forming apparatus 101, the electric power control circuit electrifies the ceramic heater 11. When the software determined that the fixing device 6 is not suitable to the main body of the image forming apparatus 101, the electrifying control is not performed to the ceramic heater 11.

The action of the safety circuit when the first connector is disconnected will be described below. When the first connector 103 is disconnected, the second and third terminals of the first connector are not connected for the image formation, and the means for detecting the rated supply voltage cannot act. However, as described above, when the first connector is disconnected, the safety circuit acts to cut off electrifying the ceramic heater 11. Namely, even if the first connector is disconnected, apparatus breakage generated by malfunction of the rated supply voltage detection means can be prevented.

In the first connector 103, the second and third terminals which are used in detecting the rated supply voltage are arranged inside with respect to the terminals 1 and 8 which are connected to the jumper cable 109 (the terminals 2 and 3 are sandwiched between the terminals 1 and 8). Therefore, even if only the terminals 1, 2, and 3 become disconnected when the first connector 103 is fitted in the incomplete state, electrifying the resistors 112 and 113 from the power supply voltage Vcc is cut off, which allows electrifying the ceramic heater 11 to be avoided.

Even if the fixing power supply voltage detection means is replaced with means for detecting other specifications in the fixing device, the fixing power supply voltage detection means can be performed. For example, the specification of the pressure roller and the specification of the thermistor can be cited.

As described above, in the image forming apparatus of the first embodiment, the power supply voltage is applied to the thermistor through the first connector 103 (connector A) which connects the thermistor signal line. Therefore, when the first connector 103 is disconnected, electrifying the ceramic heater 11 is cut off by the action of the safety device, so that the trouble caused by the disconnection of the connector can be prevented. Further, the signal line for identifying the fixing device specification is connected through the first connector 103, so that the trouble caused by the disconnection of the connector can be prevented.

In the first connector 103 (connector A), the plural terminals are arranged in line, and the terminal connected to the jumper cable 109 (jumper cable A1) is arranged outside the terminal for the output signal of the temperature detection means and the terminal for the detection signal of the heating and fixing specification detection means. Therefore, even if the terminals including the terminal for the detection signal of the temperature detection means are disconnected only in one side of the first connector 103 (single-side fitting), the overheating of the electric heat generation member can be prevented.

Second Embodiment

A second embodiment of the invention will be described below. The first embodiment has the features in which the power supply voltage is applied to the main thermistor TH1 and the sub-thermistor TH2 through the first connector 103 (connector A) connected to the thermistor signal line and the signal line for identifying the type of fixing device is also connected through the first connector 103. The basic configuration of the second embodiment is similar to the first embodiment. However the second embodiment differs from the first embodiment only in the method of connecting the signal line for identifying the type of the fixing device. Only the portions different from the first embodiment will be described below.

Figure 6:
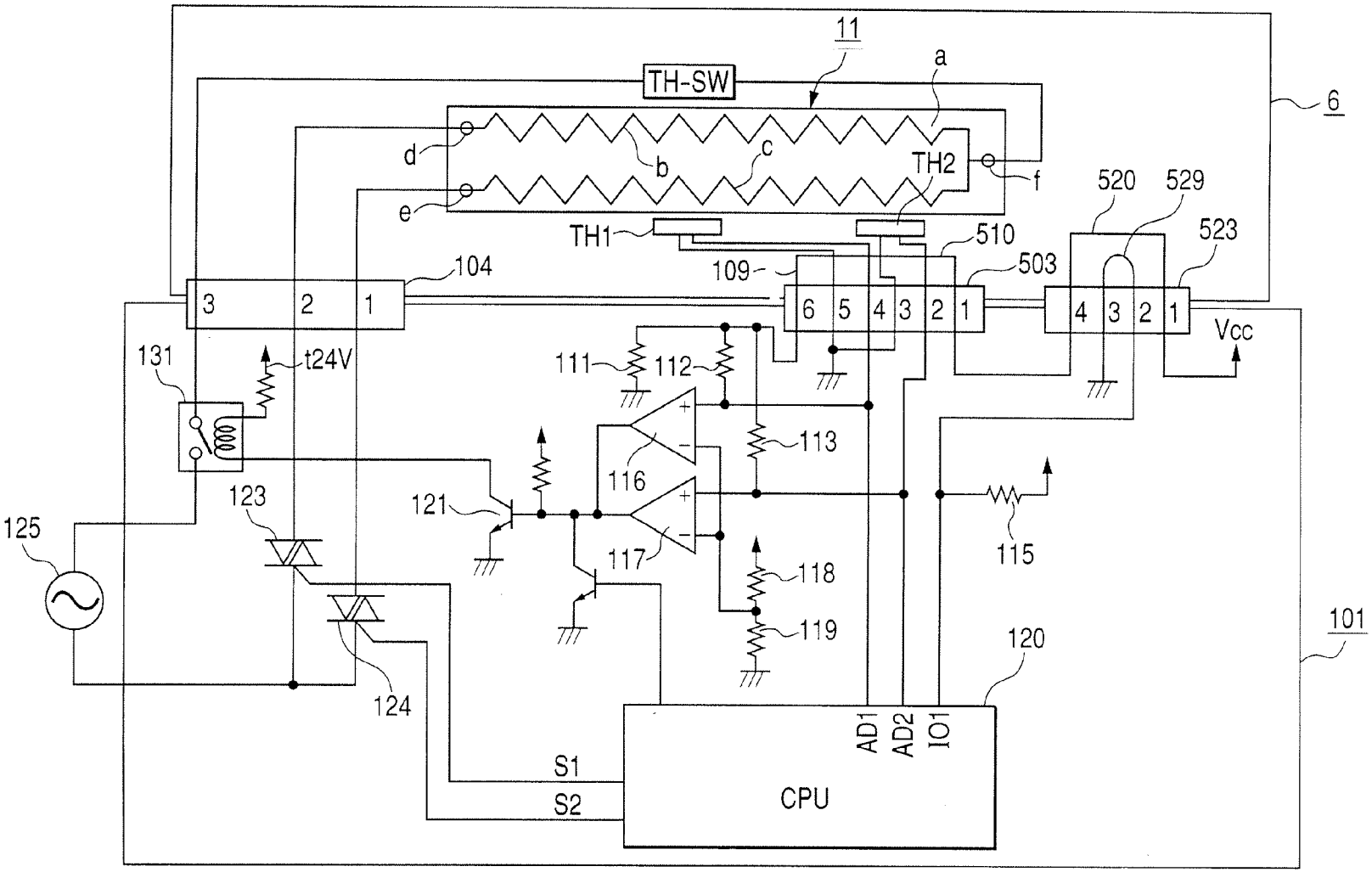
FIG. 6 is a circuit diagram showing a fixing control part in a second embodiment.
Figure 7:
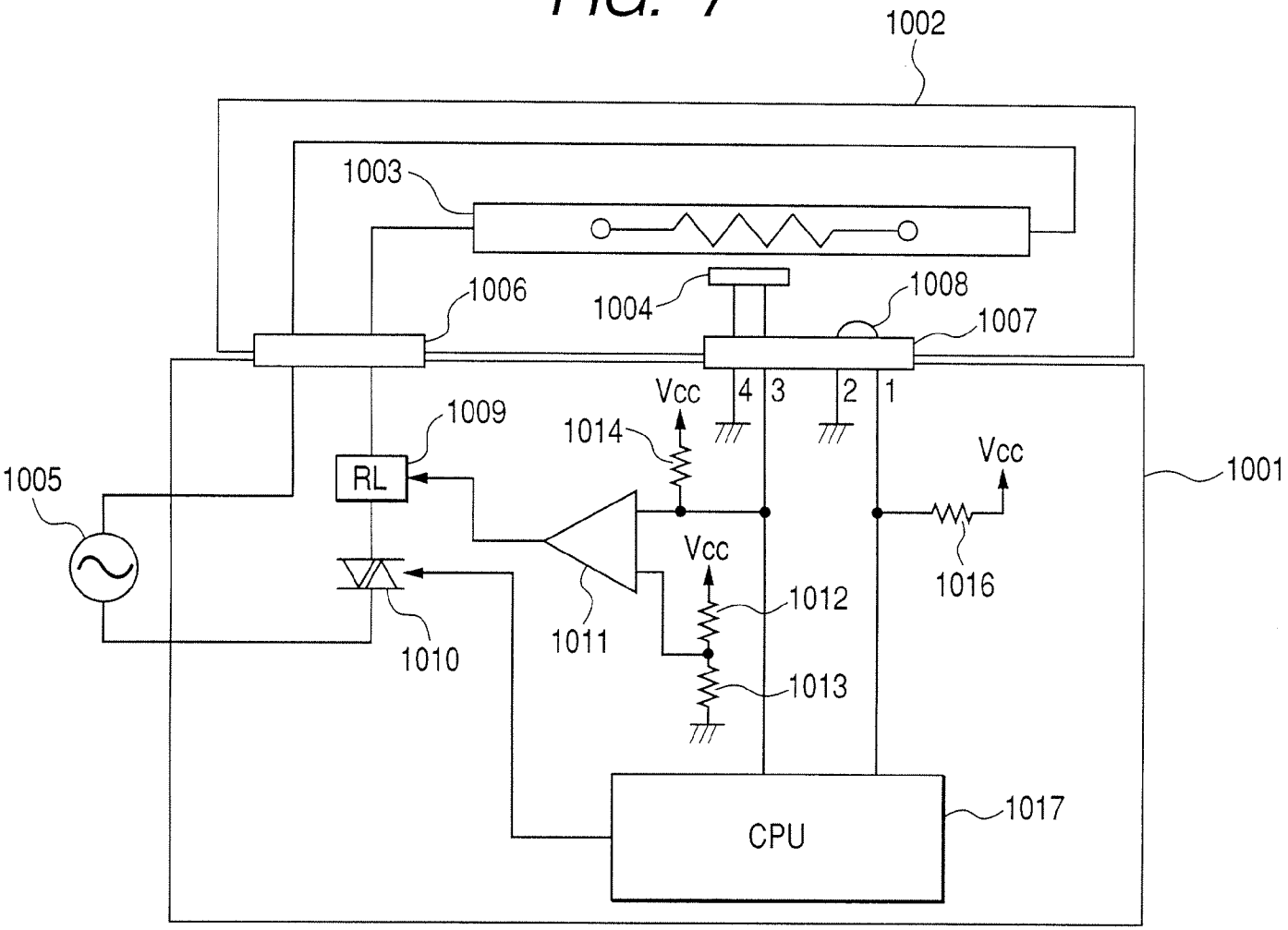
FIG. 7 is a circuit diagram showing a fixing control part of the conventional image forming apparatus.

FIG. 6 shows the configuration of the fixing device control part of the image forming apparatus according to the second embodiment. The image forming apparatus of the second embodiment has first, second, and third connectors 503, 104, and 523 which connect the fixing device 6 and a main body of the image forming apparatus 101.

The first connector 503 (connector B) is the control-system connector which connects the main thermistor TH1 and the sub-thermistor TH2.

The second connector 104 is the electric-power-supply-system connector which electrically connects the electric power supply line to the ceramic heater 11 like the second connector 104 in the first embodiment.

The third connector 523 (connector C) is the control-system connector which is connected to the fixing rated supply voltage detection signal line. In the third connector 523, the rated supply voltage detection method of the fixing device 6 is similar to the first embodiment. The terminals 2 and 3 are connected to a jumper cable 529 which is set according to the rated supply voltage of the fixing device 6. The jumper cable 529 is the heating and fixing specification means (means for detecting the rated supply voltage) for detecting the specification of the fixing device which is of the heating and fixing means. When the rated supply voltage is 100V, the second and third terminals are short-circuited by the jumper cable 529. On the other hand, when the rated supply voltage is 200V, the jumper cable 529 is not connected. The type of the fixing device 102 can be detected by the input port I01 of the CPU 120, which is changed by the presence or absence of the jumper cable 529. The first and fourth terminals of the third connector 523 are the terminal to which the power supply voltage Vcc is connected. The first terminal located on the main body side of the image forming apparatus 101 is connected to the power supply voltage Vcc, and the first terminal located on the fixing device 6 side is connected to the fourth terminal by the jumper cable 520 (jumper cable C1). When the third connector 523 is connected, the power supply voltage Vcc is applied to the fourth terminal of the main body of the image forming apparatus 101. On the other hand, when the third connector 523 is not connected, the power supply voltage Vcc is not applied to the fourth terminal. The fourth terminal is connected to the first terminal of the third connector 523.

The method of connecting the main thermistor TH1 and the sub-thermistor TH2 is similar to the first embodiment, and the main thermistor TH1 and the sub-thermistor TH2 are connected to the temperature detection circuit in the main body of the image forming apparatus 101 through the third, fourth, fifth, and sixth terminals of the first connector 503 (connector B). The first and second terminals are connected on the fixing device 6 side by the jumper cable 510 (jumper cable B1). When the first connector 503 and the third connector 523 are in the connected state, the power supply voltage Vcc is applied to the main thermistor TH1 and the sub-thermistor TH2 through the resistors 112 and 113, and the voltage levels are generated in the CPU input ports AD1 and AD2 according to the thermistor detection temperatures.

When any one of the first connector 503 and the third connector 523 is not connected, the application of the power supply voltage Vcc to the sixth terminal of the first connector 503 is stopped, and the safety circuit acts to stop electrifying the ceramic heater 11.

As described above, in the image forming apparatus of the second embodiment, the power supply voltage is applied to the thermistor through the first connector 503 (connector B) which connects the thermistor signal line and the third connector 523 (connector C) which connects the signal line for identifying the fixing device specification. Namely, the electric power supply to the temperature detection means TH1 and TH2 is connected to the jumper cable 510 (jumper cable B1) connected to the first connector 503 (connector B) and the jumper cable 520 (jumper cable C) connected to the third connector 523 (connector C), and the electric power supply cut-off means (safety circuit) acts to stop electrifying the ceramic heater 11 when at least one of the first connector 503 and the third connector 523 is not connected. Therefore, when any one of the first connector 503 and the third connector 523 is disconnected, the safety circuit acts to stop electrifying the ceramic heater, which prevents the trouble caused by the disconnection of the connector.

In the second embodiment, in the first connector 503 (connector B), the plural terminals are arranged in line, and the terminal connected to the jumper cable 510 (jumper cable B1) is arranged outside the terminal for the output signal of the temperature detection means. Therefore, even if the terminals including the terminal for the detection signal of the temperature detection means are disconnected only in one side of the first connector 503, the overheating of the electric heat generation member can be prevented.

In the third connector 523 (connector C), the plural terminals are arranged in line, and the terminal connected to the jumper cable 520 (jumper cable C1) is arranged outside the terminal for the detection signal of the heating and fixing specification detection means. Therefore, even if the terminals including the terminal for the detection signal of the heating and fixing specification detection means are disconnected only in one side of the third connector 523, the overheating of the electric heat generation member can be prevented.

In the image forming apparatus, the image forming means for forming the unfixed toner image to the recording medium is not limited to the transfer type electrophotographic process of the embodiments. For example a direct electrophotographic process, an electrostatic recording process, and magnetic recording process can also be applied to the image forming means. Needless to say, the heat fixing device is not limited to the film heating type of heating device of the embodiments.

The invention claimed is:

1. A main body of an image forming apparatus to which a heat fixing device is attached, the heat fixing device having a heat generating part which has an electric heat generation member for generating heat by electrifying and a temperature detection device for detecting a temperature of the heat generating part, the heat fixing device heating and fixing an unfixed toner image onto a recording medium, the main body of the image forming apparatus having an image forming part which forms the unfixed toner image in the recording medium, said main body comprising:

a control part which controls electric power supplied to the electric heat generation member;

an electric power supply cut-off circuit which cuts off electric power supply to the electric heat generation member; and a determination circuit which causes the electric power supply cut-off circuit to be in a cut-off state by determining whether output of the temperature detection device indicates a predetermined anomaly, wherein the heat fixing device and the main body of the image forming apparatus are electrically connected to each other with a connector, the temperature detection device and the determination circuit are connected through the connector, power supply voltage is supplied to the temperature detection device via a jumper cable connected to the connector from the main body of the image forming apparatus while passing through a path detouring to the heat fixing device side, and the determination circuit causes the electric power supply cut-off circuit to be cut off, when the power supply voltage is not supplied to the temperature detection device because the connector is in a disconnected state.

2. A main body of an image forming apparatus according to claim 1, wherein said connector is a first connector and the heat fixing device has a specification signal output part which outputs a signal indicating specifications of the heat fixing device, the signal from the specification signal output part is transmitted to the control part via a second connector, the control part controls the electric power supplied to the electric heat generation member based on the specifications signal, the power supply voltage is supplied to the temperature detection device via the jumper cable connected to the first connector and via the jumper cable connected the second connector while passing through path detouring twice to the heat fixing device side, and the determination circuit causes the electric power supply cut-off circuit to be cut off, when the power supply voltage is not supplied to the temperature detection device because at least one of the first connector and the second connector is in the disconnected state.

3. A main body of an image forming apparatus according to claim 2, wherein the specification signal output part outputs a signal indicating a rated supply voltage to be supplied to the fixing device.

4. A main body of an image forming apparatus according to claim 2, wherein the plurality of terminals are arranged in line in the first connector, and the connection terminal for the output signal of the temperature detection signal is arranged in the insides of the two terminals to which the jumper cables are connected.

5. A main body of an image forming apparatus according to claim 2, wherein the plurality of terminals are arranged in line in the second connector, and the connection terminal for the signal from the specification signal output part is arranged in the insides of the two terminals to which the jumper cables are connected.

6. A main body of an image forming apparatus according to claim 1, wherein the heat fixing device has the specification signal output part which outputs the signal indicating the specifications of the heat fixing device, the signal from the specification signal output part is transmitted to the control part via the connector, and the control part controls the electric power supplied to the electric heat generation member based on the specifications signal.

7. A main body of an image forming apparatus according to claim 6, wherein a plurality of terminals are arranged in line in the connector, and a connection terminal for an output signal of the temperature detection signal and a connection terminal for a signal from the specification signal output part are arranged in insides of two terminals to which the jumper cables are connected.

8. A main body of an image forming apparatus according to claim 1, wherein the temperature detection device is a thermistor.

9. An image forming apparatus comprising:

a heat fixing device which heats and fixes an unfixed toner to a recording medium, wherein said heat fixing device has a heat generating part which has an electric heat generation member for generating heat by electrifying;

a temperature detection device which detects a temperature of the heat generating part; and a main body having an image forming part which forms the unfixed toner image in the recording medium, said main body of the image forming appartus comprising:

a control part which controls electric power supplied to the electric heat generation member;

an electric power supply cut-off circuit which cuts off electric power supply to the electric heat generation member; and a determination circuit which causes the electric power supply cut-off circuit to be in a cut-off state by determining whether output of the temperature detection device indicates a predetermined anomaly, wherein the heat fixing device and the main body of the image forming apparatus are electrically connected to each other with a connector, wherein the temperature detection device and the determination circuit are connected through the connector, wherein power supply voltage is supplied to the temperature detection device via a jumper cable connected to the connector from the main body of the image forming appartus while passing through a path detouring to the heat fixing device side, and wherein the determination circuit causes the electric power supply cut-off circuit to be cut-off, when the power supply voltage is not supplied to the temperature detection device because the connector is in a disconnected state.

* * * * *

UNITED STATES PATENT AND TRADEMARK OFFICE

CERTIFICATE OF CORRECTION

PATENT NO. : 7,266,314 B2
APPLICATION NO. : 11/183879
DATED : September 4, 2007
INVENTOR(S) : Hiroshi Takami It is certified that error appears in the above-identified patent and that said Letters Patent is hereby corrected as shown below:

COLUMN 3:
Line 16, “resulting” should read --resulting in--.
Line 34, “control-system” should read --control system--.

COLUMN 4:
Line 18, “the” should read --to the--.

COLUMN 5:
Line 11, “are a schematic view” should read --are schematic views--.

COLUMN 7:
Line 2, “counter clockwise” should read --counterclockwise--.
Line 49, “paper” should read --paper in--.

COLUMN 8:
Line 64, “from” should read --from the--.

COLUMN 10:
Line 59, ““becomes” should read --becomes--.

COLUMN 11:
Line 34, “comparator” should read --comparators--.

COLUMN 12:
Line 9, “cable 101.” should read --cable 110.--.

COLUMN 13:
Line 15, “However” should read --However,--.
Line 48, “device 102” should read --device 6--.
Line 51, “terminal” should read --terminals--.

UNITED STATES PATENT AND TRADEMARK OFFICE

CERTIFICATE OF CORRECTION

PATENT NO. : 7,266,314 B2
APPLICATION NO. : 11/183879
DATED : September 4, 2007
INVENTOR(S) : Hiroshi Takami It is certified that error appears in the above-identified patent and that said Letters Patent is hereby corrected as shown below:

COLUMN 15:
Line 41, "connected the" should read --connected to the--.

Signed and Sealed this

Seventeenth Day of June, 2008

JON W. DUDAS
*Director of the United States Patent and Trademark Office*